US009448010B2

(12) United States Patent
Van Lieu

(10) Patent No.: US 9,448,010 B2
(45) Date of Patent: Sep. 20, 2016

(54) HEAT EXCHANGER

(75) Inventor: Pieter Van Lieu, Westfield, MA (US)

(73) Assignee: HAMILTON SUNDSTRAND CORPORATION, Windsor Locks, CT (US)

( * ) Notice: Subject to any disclaimer, the term of this patent is extended or adjusted under 35 U.S.C. 154(b) by 998 days.

(21) Appl. No.: 13/468,164

(22) Filed: May 10, 2012

(65) Prior Publication Data

US 2013/0299144 A1 Nov. 14, 2013

(51) Int. Cl.

| | |
|---|---|
| ***F28F 9/00*** | (2006.01) |
| ***F28D 9/00*** | (2006.01) |
| ***F28F 3/02*** | (2006.01) |
| *F28D 21/00* | (2006.01) |

(52) U.S. Cl.

CPC ..... *F28D 9/0075* (2013.01); *F28F 3/025* (2013.01); *F28F 9/00* (2013.01); *F28D 2021/0021* (2013.01); *F28F 2250/106* (2013.01)

(58) Field of Classification Search

CPC ..... F28F 3/025; F28F 2250/106; F28D 2021/0021; F28D 9/00; F28D 9/0075

USPC ..... 165/165, 166, 175, 149

See application file for complete search history.

(56) References Cited

U.S. PATENT DOCUMENTS

| | | | | |
|---|---|---|---|---|
| 2,985,433 | A * | 5/1961 | Simpelaar | 165/166 |
| 3,542,124 | A * | 11/1970 | Bridgnell et al. | 165/166 |
| 4,848,450 | A | 7/1989 | Lapkowsky | |
| 6,374,904 | B1 * | 4/2002 | Hurst | 165/78 |
| 6,904,963 | B2 | 6/2005 | Hu | |
| 7,516,780 | B2 * | 4/2009 | Schmalzried | 165/152 |
| 2005/0045314 | A1 * | 3/2005 | Elbourini | 165/152 |
| 2007/0144717 | A1 | 6/2007 | Zaffetti et al. | |
| 2007/0267187 | A1 * | 11/2007 | Wolk | 165/181 |
| 2008/0093059 | A1 * | 4/2008 | Nishida | 165/133 |
| 2008/0110603 | A1 | 5/2008 | Fellague et al. | |
| 2011/0180242 | A1 * | 7/2011 | Urata et al. | 165/166 |
| 2013/0061617 | A1 * | 3/2013 | Borghese et al. | 62/87 |

FOREIGN PATENT DOCUMENTS

| | | | |
|---|---|---|---|
| CN | 1478008 | A | 2/2004 |
| CN | 201568133 | U | 9/2010 |
| JP | 2009198033 | A * | 9/2009 |

OTHER PUBLICATIONS

Chinese Office Action for Application No. 201310168578.3; Issued Jan. 27, 2015; Mailed on Mar. 31, 2015; 10 pages.

* cited by examiner

*Primary Examiner* — Tho V Duong
(74) *Attorney, Agent, or Firm* — Cantor Colburn LLP

(57) ABSTRACT

A primary heat exchanger for use in an environmental control system of an aircraft is provided having a rectangular core. The core includes a plurality of alternately stacked first fluid layers and second fluid layers. The core has a length to width ratio of about 4.88 and a width to height ratio of about 2.37. A first header is positioned adjacent a first surface of the core and a second header is positioned adjacent a second opposite surface of the core. The first header and the second header form a portion of a flow path for a first fluid. An inlet flange is positioned adjacent a third surface of the core. An outlet flange is positioned adjacent a fourth, opposite surface of the core to form a portion of a flow path for a second fluid.

10 Claims, 5 Drawing Sheets

HEAT EXCHANGER

BACKGROUND OF THE INVENTION

Exemplary embodiments of this invention generally relate to environmental control systems of an aircraft and, more particularly, to a primary heat exchanger of such an environmental control system.

Environmental control systems (ECS) for aircrafts and other vehicles are utilized to provide a conditioned airflow for passengers and crew within an aircraft. One type of environmental control system generally operates by receiving fresh air into a ram air intake located near the ECS equipment bay. The fresh ram air is supplied to at least one electric motor-driven air compressor that raises the air pressure to, for example, the desired air pressure for the cabin. From the at least one air compressor, the air is supplied to an optional ozone converter. Because air compression creates heat, the air is then supplied to an air conditioning pack in which the air is cooled before being transported to the cabin.

As the size of aircraft cabins increase, the demands placed on the ECS also increase. An ECS having a conventional primary heat exchanger has difficulty meeting the greater cooling requirements of such an aircraft.

BRIEF DESCRIPTION OF THE INVENTION

According to one embodiment of the invention, a primary heat exchanger for use in an environmental control system of an aircraft is provided having a rectangular core. The core includes a plurality of alternately stacked first fluid layers and second fluid layers. The core has a length to width ratio of about 4.88 and a width to height ratio of about 2.37. A first header is positioned adjacent a first surface of the core and a second header is positioned adjacent a second opposite surface of the core. The first header and the second header form a portion of a flow path for a first fluid. An inlet flange is positioned adjacent a third surface of the core. An outlet flange is positioned adjacent a fourth, opposite surface of the core to form a portion of a flow path for a second fluid.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
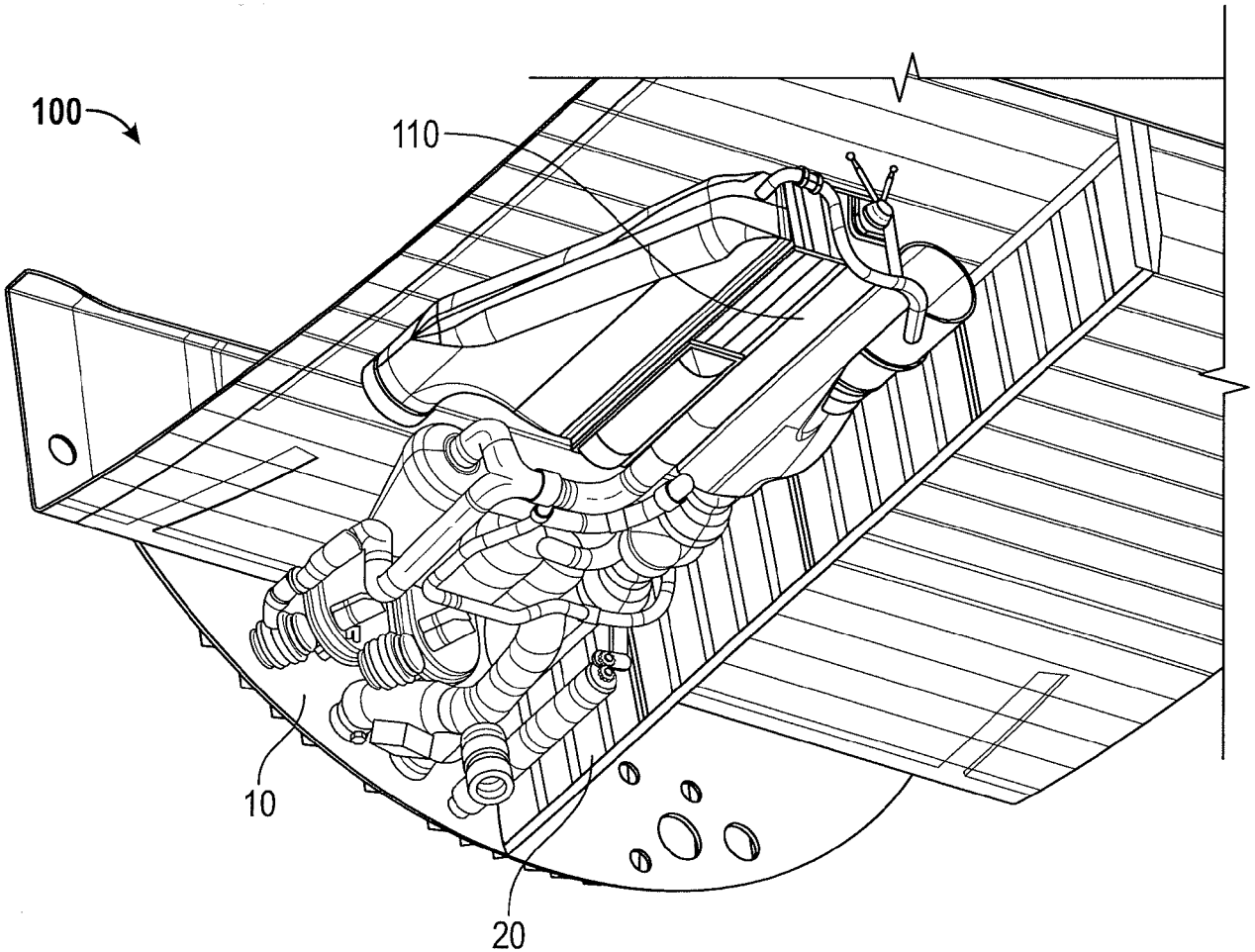
FIG. 1 is a perspective view of a portion of an environmental control system of an aircraft.

Referring now to FIG. 1, a portion of an environmental control system (ECS) used on an aircraft, such as an air conditioning ECS pack 100 for example, is illustrated. The ECS typically includes various components such as, for example, a vapor cycle system, turbo compressors, a primary heat exchanger 110, and other components which are closely packaged to define an ECS pack 100. The ECS pack 100 is mounted within an ECS bay of the aircraft. In one embodiment, the ECS pack 100 is mounted adjacent a front spar 10 and a keel beam 20 at the interface between the aircraft fuselage and a wing.

Figure 2:
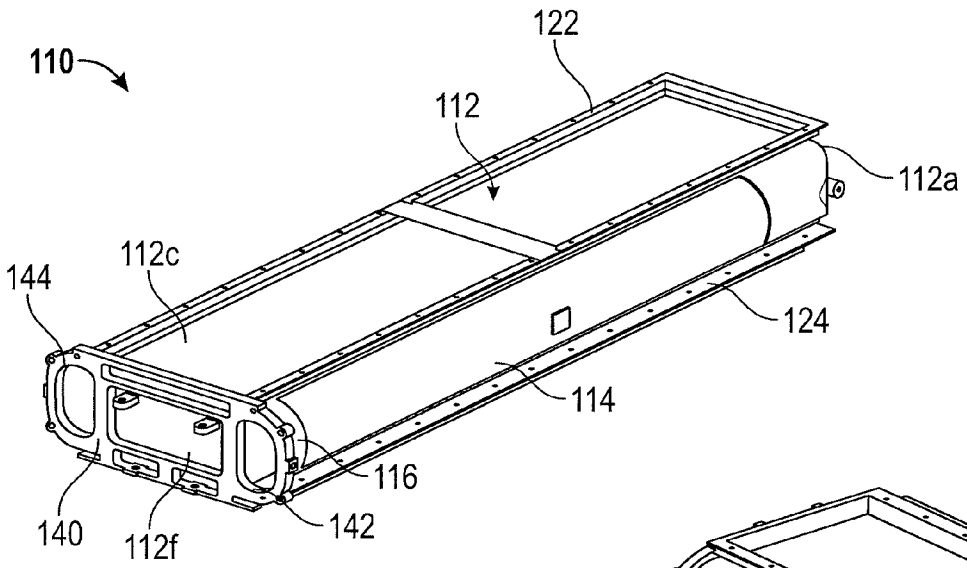
FIG. 2 is a perspective view of a primary heat exchanger according to an embodiment of the invention.
Figure 3:
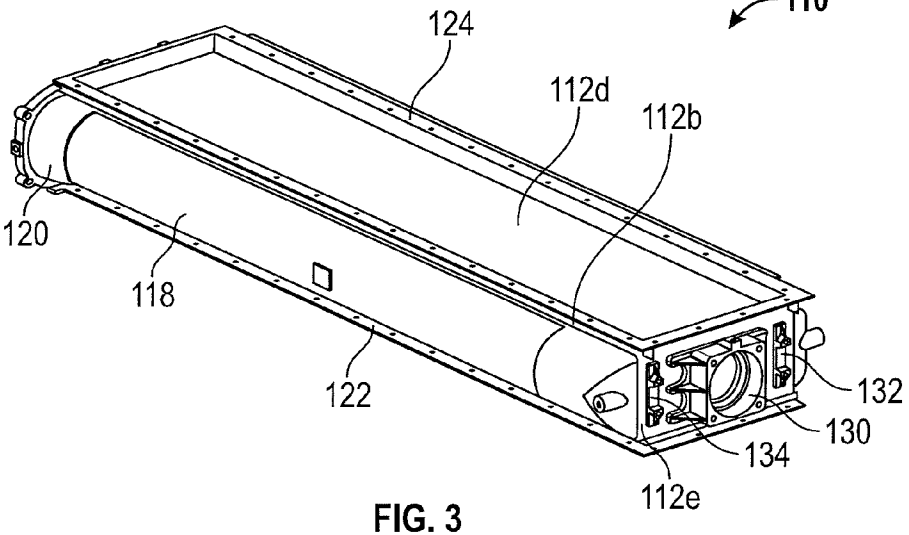
FIG. 3 is an alternate perspective view of a primary heat exchanger according to an embodiment of the invention.
Figure 4:
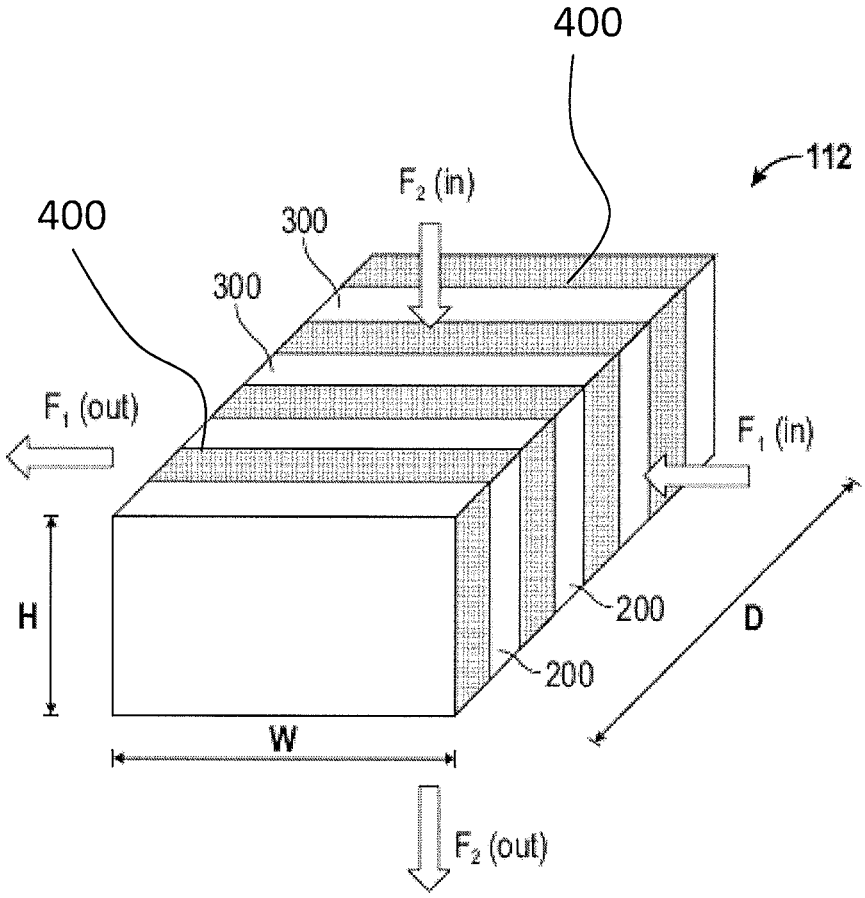
FIG. 4 is a perspective view of a primary heat exchanger core according to an embodiment of the invention.
Figure 5A:
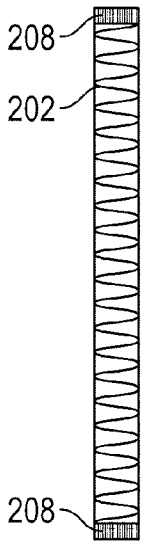
FIGS. 5A and 5B are front and side views of an exemplary first fluid layer according to an embodiment of the invention.
Figure 5B:
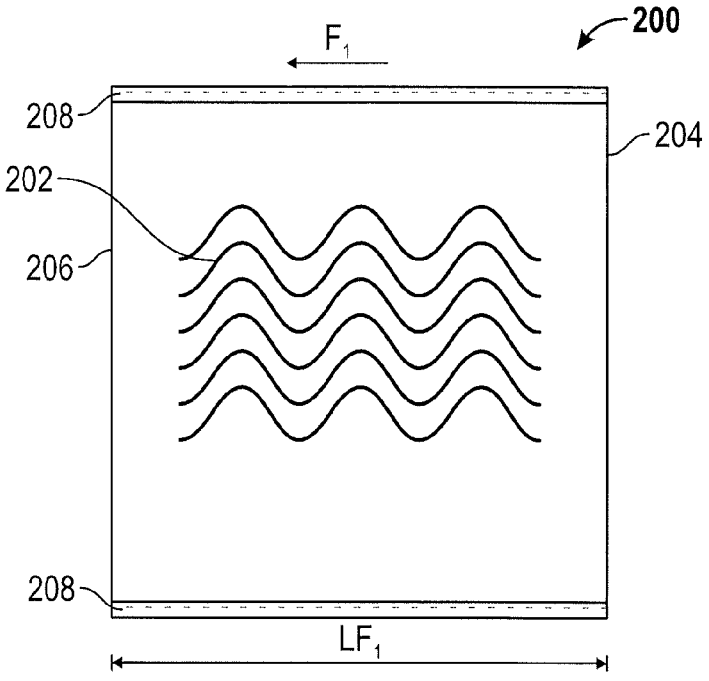
Figure 6A:
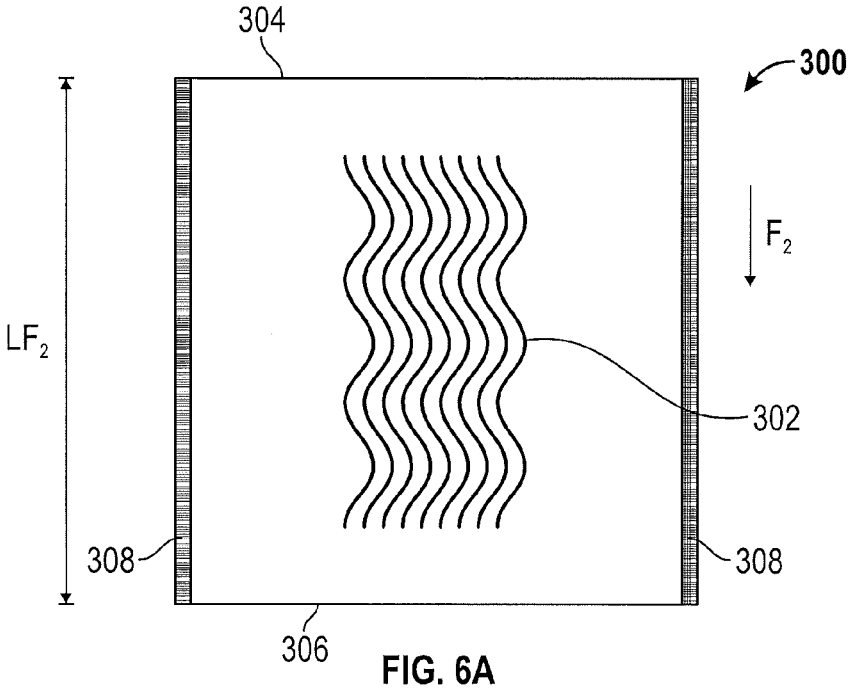
FIGS. 6A and 6B are front and side views of an exemplary second fluid layer according to an embodiment of the invention.
Figure 6B:
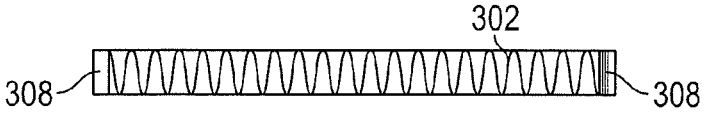

Referring now to FIGS. 2 and 3, two different views of a primary heat exchanger 110 of the ECS pack 100 are shown. The primary heat exchanger 110 is generally rectangular in shape and is structurally supported by a core 112. The core 112 of the heat exchanger 110 is centrally located, between two substantially similar hot headers 114, 118. The first and second hot header 114, 118 are fluidly connected to a first surface 112*a* and a second surface 112*b* of the core 112 respectively, to create a fluid flow path through the core 112. In one embodiment, the hot headers 114, 118 are generally D shaped and are constructed of extruded aluminum. An inlet flange 122 and an outlet flange 124 border a third surface 112*c* and a fourth surface 112*d* of the heat exchanger core 112. The third surface and fourth surface 112*c*, 112*d* are opposing surfaces and are distinct from the first and second opposing surfaces 112*a*, 112*b*. In one embodiment, the inlet and outlet flanges 122, 124 border the surfaces of the core 112 having the largest surface area.

At least one mount 130 and a transition plate 140 are connected to opposing fifth and sixth surfaces 112*e*, 112*f* of the core 112 respectively, adjacent the inlet and outlet flanges 122, 124. In one embodiment, the transition plate 140 is located at the fore and the mount 130 is aft of the heat exchanger core 112. In one embodiment, a mount, such as a primary mount 130 for example, is connected to the surface of the core 112 having the smallest surface area. A primary mount 130 is positioned centrally on the fifth surface 112*e* of the core 112. The primary mount 130 interfaces with another surface of the ECS pack 100 (FIG. 1) to hold the primary heat exchanger 110 in a desired position. For example, the primary mount 130 may constrain movement of the primary heat exchanger 110 in two degrees of freedom. A fail safe mount 132 may also be attached to the fifth surface 112*e* of the core 112 for use in the event that the primary mount fails 130. In one embodiment, fail safe mounts 132, 134 are positioned on opposing sides of the primary mount 130. The transition plate 140 generally extends to an outside surface of each hot header 114, 118 and includes a first opening 142 adjacent an end of the first hot header 114 and a second opening 144 adjacent an end of the second hot header 118. In one embodiment, the first and second openings 142, 144 have a shape generally complementary to the cross-section of each hot header 114, 118 (e.g., D-shaped). A header cap 116, 120 may connect the first and second openings 142, 144 in the transition plate 140 to the adjacent ends of the first and second hot headers 114, 118 respectively.

Details of the construction of the core 112 of the primary heat exchanger 110 are illustrated in FIGS. 4-7. More particularly, the core 112 of the primary heat exchanger 110 has a plate-fin construction with crossflow of a first warm fluid and a second cool fluid there through. An exemplary core may have depth D to width W ratio of about 4.88 and a width W to height H ratio of about 2.37. In one embodiment, the core 112 has a width W of about 14.7 inches (37.34 cm), a height H of about 6.2 inches (15.75 cm) and a depth D of about 71.702 inches (182.12 cm). The core 112 of the heat exchanger 110 includes a plurality of first fluid layers 200 and second fluid layers 300. The first fluid layers 200 have a fluid pathway such that a first warm fluid, such as warm compressed air fir example, flows through the core 112 in a first direction, indicated by arrow F1. The second fluid layers 300 have a fluid pathway such that a second cool fluid, for example cool RAM air, flows through the core 112 in a second direction, indicated by arrow F2. In one embodiment, the direction of the second fluid flow is perpendicular to the direction of the first fluid flow. The first and second fluid layers 200, 300 are alternately stacked along the depth D of the core. Thin plates 400 separate adjacent fluid layers 200, 300. In one embodiment, the plates have a thickness of about 0.014 inches (0.036 cm).

Referring to FIGS. 5A, 5B, 6A and 6B, an exemplary first fluid layer 200 and second fluid layer 300 are illustrated. Each first fluid layer 200 and second fluid layer 300 has a plurality of corrugated fins 202, 302 that form a fluid pathway across each fluid layer. The corrugated fins 202 of the exemplary first fluid layer 200 extend from adjacent a first, inlet edge to a second, outlet edge. The distance that the first fluid flows across the first fluid layer 200, between the inlet and outlet edges, is the first fluid flow length Ill. Similarly, the corrugated fins of the exemplary second fluid layer 300 extend from adjacent a first, inlet edge of the layer to adjacent a second, outlet edge of the layer. The distance a second fluid flows across the second fluid layer is the second fluid flow length LF2. The configurations of the corrugated fins 202, 302 of the first and second fluid layers 200, 300 are defined by a fin height, a fin thickness, and the number of fins per length. The other edges of the layers, excluding the inlet and outlet edges are covered by closure bars, to prevent fluid flow in an alternate path.

The fin configurations of both the first fluid layers 200 and the second fluid layers 300 vary based on the position of the layer within the core 112. The portion of the fluid layers 200, 300 adjacent the transition plate 140 and the primary mount 130 have "thicker" fin configurations than the centrally located portions of layers 200, 300. In one embodiment, a second fluid layer 300 having an extra thick, transition fin configuration is positioned directly adjacent the transition plate 140 and the mount 130. The fins in such an extra thick transition fin second fluid layer 300 may have a fin height of about 0.5 inches (1.27 cm), a fin thickness of about 0.005 inches (0.127 cm) and a fin frequency of about 24 fins per inch (9.45 fins per cm). In one embodiment, only two extra thick second fluid layers 300 are used within the core 112.

Adjacent the extra thick second fluid layer 300 are at least one first fluid layer 200 having a "thick" fin configuration and at least one second fluid layer 300 having a "thick" fin configuration. At least one thick fin first fluid layer 200 and one thick fin second fluid layer 300 are also positioned at an opposite end of the core 112 adjacent the mount 130. The thick fin configurations of the first fluid layer 200 and the second fluid layer 300 are not identical. In one embodiment, the thick fin first fluid layer 200 has a fin height of about 0.324 inches (0.86 cm), a fin thickness of about 0.005 inches (0.127 cm) and a fin frequency of about 20 fins per inch (7.87 fins per cm). In one embodiment, the thick fin second fluid layer 300 has a fin height of about 0.5 inches (1.27 cm), a fin thickness of about 0.005 inches (0.127 cm) and a fin frequency of about 20 fins per inch (7.87 fins per cm).

Figure 7:
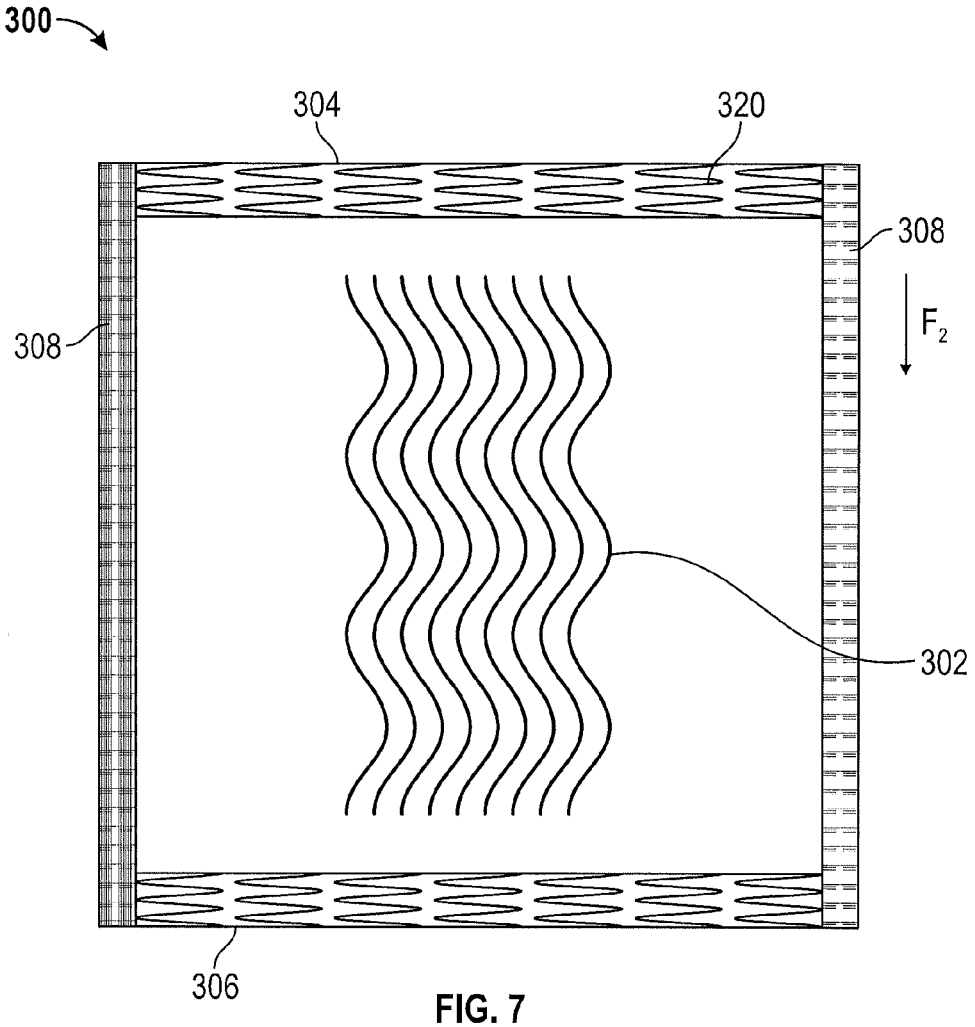
FIG. 7 is a front view of an exemplary second fluid layer having a thin fin configuration according to an embodiment of the invention.

The majority of the core 112 includes first fluid layers 200 having a thin fin configuration and second fluid layers 300 having a thin fin configuration. For example, the core 112 may include about 80 thin fin first fluid layers 200 and about 80 thin fin second fluid layers 300. The thin fin configurations of the first fluid layer 200 and the second fluid layer 300 are not identical. In one embodiment, a thin fin first fluid layer 200 has a fin height of about 0.324 inches (0.86 cm), a fin thickness of about 0.003 (0.0076 cm) inches and a fin frequency of about 20 fins per inch (7.87 fins per cm). In one embodiment, a thin fin second fluid layer 300 has a fin height of about 0.5 inches (1.27 cm), a fin thickness of about 0.003 inches (0.0076 cm) and a fin frequency of about 20 fins per inch (7.87 fins per cm). Referring to FIG. 7, the fin configuration of a thin fin second fluid layer 300 is not uniform across the flow length of the layer. In one embodiment, adjacent the inlet and outlet of each thin fin second fluid layer 300 is a corrugated guard fin 320. The guard fin 320 of a thin fin second fluid layer 300 may have a fin height of about 0.5 inches (0.86 cm), a fin thickness of about 0.008 inches (0.02 cm) and a fin frequency of about 9 fins per inch (3.54 fins per cm).

The primary heat exchanger 110 is an air to air, single pass heat exchanger. A first fluid passes through the first opening 142 of the transition plate 140 into the first hot header 114. The pressure of the first fluid entering the first hot header 114 causes the first fluid to move not only longitudinally along the length of the hot header 114, but also in a perpendicular direction through the core 112. The first fluid then enters the second hot header 118 on the opposite side of the core 112, where it exits through the adjacent opening 144 in the transition plate 140. At the same time, a second fluid enters the third surface 112*c* of the core 112 having a connected inlet flange 122. The second fluid travels through the core 112 in a direction perpendicular to the flow of the first fluid, and exits at the opposite fourth surface 112*d* of the core 112 having a connected outlet flange 124.

The primary heat exchanger cools hot compressed air from the ECS using cool air from the RAM. Due its increased size, the primary heat exchanger 110 is able to reduce the temperature of the hot compressed air about 250° F. In addition, the heat exchanger 110 provides structural support for the ECS.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while the various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A primary heat exchanger for use in an environmental control system of an aircraft, comprising:

a rectangular core having a plurality of alternately stacked first fluid layers and second fluid layers, the rectangular core having a depth to width ratio of about 4.88 and a width to height ratio of about 2.37;

a first header substantially coextensive to a first surface of the core and a second header substantially coextensive to a second, opposite surface of the core, wherein the first header and the second header form a portion of a flow path for a first fluid; and an inlet flange adjacent a third surface of the core and an outlet flange adjacent a fourth, opposite surface of the core, wherein the inlet flange and outlet flange form a portion of a flow path for a second fluid;

at least one mount adjacent a fifth surface of the core for coupling the primary heat exchanger to the aircraft; and a transition plate having a first opening adjacent an end of the first header and a second opening adjacent an end of the second header;

wherein each of the first fluid layers and the second fluid layers includes a plurality of corrugated fins that extend from an inlet edge to an outlet edge to form a flow path for a fluid, and a fin configuration of at least one of the first fluid layer and the second fluid layer being configured to vary based on a position of the first fluid layer or second fluid layer within the rectangular core.

2. The primary heat exchanger according to claim 1, wherein the rectangular core has a width of about 14.7 inches (37.34 cm), a height H of about 6.2 inches (15.75 cm) and a depth D of about 71.7 inches (182.12 cm).

3. The primary heat exchanger according to claim 1, wherein at least one first fluid layer includes a plurality of corrugated fins having a fin height of about 0.324 inches (0.86 cm), a fin thickness of about 0.005 inches (0.0127 cm) and a fin frequency of about 20 fins per inch (7.87 fins per cm).

4. The primary heat exchanger according to claim 1, wherein at least one first fluid layer includes a plurality of corrugated fins having a fin height of about 0.324 inches (0.86 cm), a fin thickness of about 0.003 inches (0.0076 cm) inches and a fin frequency of about 20 fins per inch (7.87 fins per cm).

5. The primary heat exchanger according to claim 1, wherein at least one second fluid layer includes a plurality of corrugated fins having a fin height of about 0.5 inches (1.27 cm), a fin thickness of about 0.005 inches (0.0127 cm) and a fin frequency of about 24 fins per inch (9.45 fins per cm).

6. The primary heat exchanger according to claim 1, wherein at least one second fluid layer includes a plurality of corrugated fins having a fin height of about 0.5 inches (1.27 cm), a fin thickness of about 0.005 inches (0.0127 cm) and a fin frequency of about 20 fins per inch (7.87 fins per cm).

7. The primary heat exchanger according to claim 1, wherein at least one second fluid layer includes a plurality of corrugated fins having a fin height of about 0.5 inches (1.27 cm), a fin thickness of about 0.003 inches (0.0076 cm) and a fin frequency of about 20 fins per inch (7.87 fins per cm).

8. The primary heat exchanger according to claim 7, further comprising a plurality of guard fins adjacent the inlet edge and outlet edge of the second fluid layer, wherein the guard fins have a first fin configuration and the plurality of corrugated fins have a second, different fin configuration.

9. The primary heat exchanger according to claim 8, wherein the guard fins have a fin height of about 0.5 inches (0.86 cm), a fin thickness of about 0.008 inches (0.02 cm) and a fin frequency of about 9 fins per inch (3.54 fins per cm).

10. The primary heat exchanger according to claim 1, the flow path of the plurality of first fluid layers is perpendicular to the flow path of the plurality of second fluid layers.

* * * * *